US010259222B2

(12) United States Patent
Tamaru et al.

(10) Patent No.: US 10,259,222 B2
(45) Date of Patent: Apr. 16, 2019

(54) LIQUID EJECTION HEAD AND LIQUID EJECTION APPARATUS

(71) Applicant: CANON KABUSHIKI KAISHA, Tokyo (JP)

(72) Inventors: Yuji Tamaru, Yokohama (JP); Yuichiro Akama, Tokyo (JP); Naoko Tsujiuchi, Kawasaki (JP); Sayaka Seki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/645,826

(22) Filed: Jul. 10, 2017

(65) Prior Publication Data

US 2018/0015721 A1 Jan. 18, 2018

(30) Foreign Application Priority Data

Jul. 13, 2016 (JP) ..... 2016-138189

(51) Int. Cl.
*B41J 2/14* (2006.01)
*B41J 2/145* (2006.01)

(52) U.S. Cl.
CPC ..... *B41J 2/1433* (2013.01); *B41J 2/1404* (2013.01); *B41J 2/145* (2013.01)

(58) Field of Classification Search
CPC ..... B41J 2/17513; B41J 2/175; B41J 2002/14419; B41J 2002/14459; B41J 2/1404; B41J 2/1433; B41J 2/14145; B41J 2/14; B41J 2/145
USPC ..... 347/9, 40, 47, 84, 85
See application file for complete search history.

(56) References Cited

U.S. PATENT DOCUMENTS

2008/0001994 A1* 1/2008 Kaneko ..... B41J 2/1404 347/40
2013/0187987 A1* 7/2013 Kubota ..... B41J 2/14145 347/47

FOREIGN PATENT DOCUMENTS

JP 2012-51235 A 3/2012

* cited by examiner

*Primary Examiner* — Jannelle M LeBron
(74) *Attorney, Agent, or Firm* — Canon U.S.A., Inc. IP Division

(57) ABSTRACT

A liquid ejection head includes a substrate in which at least four inlets to which a liquid is supplied are arranged, and an ejection port forming member provided with an ejection port from which the liquid supplied to the inlets is ejected and provided in the substrate. The inlets are each formed along a first direction and are arranged in a second direction which crosses the first direction. A plurality of inter-inlet areas sandwiched between the inlets adjacent to each other has at least two types of areas different in distance between the inlets adjacent to each other, and, among the inter-inlet areas, an area positioned on each of both ends of the substrate is different from an area in which the distance between the inlets is the shortest.

6 Claims, 8 Drawing Sheets

LIQUID EJECTION HEAD AND LIQUID EJECTION APPARATUS

BACKGROUND OF THE INVENTION

Field of the Invention

The present disclosure relates to a liquid ejection head and a liquid ejection apparatus for ejecting a liquid.

Description of the Related Art

A liquid ejection head used in a liquid ejection apparatus such as an inkjet recording apparatus generally includes a print element board for ejecting a liquid. The print element board is provided with a substrate including inlets to which the liquid is supplied, and an ejection port forming member including ejection ports from which the liquid is ejected. The ejection port forming member is provided on the substrate.

In the liquid ejection head described above, if stress is caused on an interface between the substrate and the ejection port forming member, the ejection port forming member may be peeled away from the substrate. To address this issue, Japanese Patent Laid-Open No. 2012-51235 discloses a liquid ejection head which includes beam-shaped protrusions provided at positions to face inlets on a substrate and provided with an ejection port forming member along the inlets in a longitudinal direction. The liquid ejection head includes reinforcing ribs formed integrally with the beam-shaped protrusions and connected to the substrate. In the liquid ejection head, a slit is formed in the beam-shaped protrusion along the inlets in the longitudinal direction.

In the liquid ejection head disclosed in Japanese Patent Laid-Open No. 2012-51235, since a closely-contact area between the substrate and the ejection port forming member is increased by the reinforcing ribs and part of the stress is absorbable by deformation of the slit, peeling of the ejection port forming member away from the substrate can be reduced.

Recently, in the liquid ejection head, increasing the number of ejection ports is required for higher-quality recording or higher-speed recording and, therefore, an ejection port array is becoming longer and the substrate is becoming further longer accordingly. From the viewpoint of reducing the manufacturing cost, in order to increase the yield in the manufacture of the substrate, reducing a width of the substrate by reducing an inter-inlet distance in the liquid ejection head provided with a plurality of inlets is required.

However, since the longer the substrate, the higher the aspect ratio of the substrate becomes, rigidity of the substrate is lowered. Further, since the shorter the inter-inlet distance, the smaller a volume of a substrate member between the adjacent inlets becomes, rigidity of the substrate is lowered. When rigidity of the substrate is lowered, the substrate is easily deformed by the stress caused on the interface between the substrate and the ejection port forming member and, therefore, the substrate and the ejection port forming member are easily peeled away from each other. In an elongated substrate or a substrate in which an inter-inlet distance is shortened, there is an issue that the substrate and the ejection port forming member are easily peeled away from each other.

Thus, in a liquid ejection head provided with a plurality of inlets, an issue of peeling of the ejection port forming member away from the substrate is becoming increasingly serious as the substrate becomes more and more elongated and the inter-inlet distance becomes shorter and shorter.

SUMMARY OF THE INVENTION

The disclosure provides a liquid ejection head and a liquid ejection apparatus capable of further reducing peeling of an ejection port forming member away from a substrate.

A first liquid ejecting head in accordance with the disclosure includes: a substrate in which at least four inlets to which a liquid is supplied are arranged; and an ejection port forming member provided in the substrate and provided with an ejection port from which the liquid supplied to the inlets is ejected, wherein the inlets are each formed along a first direction and are arranged in a second direction which crosses the first direction, and wherein a plurality of inter-inlet areas sandwiched between the inlets adjacent to each other has at least two types of areas different in distance between the inlets adjacent to each other, and, among the inter-inlet areas, an area positioned on each of both ends of the substrate in the second direction is different from an area in which the distance is the shortest.

A second liquid ejecting head in accordance with the disclosure includes: a substrate in which at least four inlets to which a liquid is supplied are arranged; and an ejection port forming member provided with an ejection port from which the liquid supplied to the inlets is ejected and provided in the substrate, wherein the inlets are each formed along a first direction and are arranged in a second direction which crosses the first direction, and wherein a plurality of inter-inlet areas sandwiched between the inlets adjacent to each other has at least three types of areas different in distance between the inlets adjacent to each other, and an inter-inlet area in which the distance is the longest and an inter-inlet area in which the distance is the shortest are not adjacent to each other.

A third liquid ejecting head in accordance with the disclosure includes: a substrate in which at least four inlets to which a liquid is supplied are arranged; and an ejection port forming member provided in the substrate and provided with an ejection port from which the liquid supplied to the inlets is ejected, wherein the inlets are each formed along a first direction and are arranged in a second direction which crosses the first direction, and wherein a plurality of inter-inlet areas sandwiched between the inlets adjacent to each other has at least two types of areas different in distance between the inlets adjacent to each other, and, among the inter-inlet areas, an area in which the distance is the shortest is positioned in, among the inter-inlet areas, an area other than both ends of the substrate in the second direction.

A liquid ejection apparatus in accordance with the disclosure includes one of the liquid ejection heads described above.

Further features of the present disclosure will become apparent from the following description of exemplary embodiments with reference to the attached drawings.

DESCRIPTION OF THE EMBODIMENTS

Figure 1:
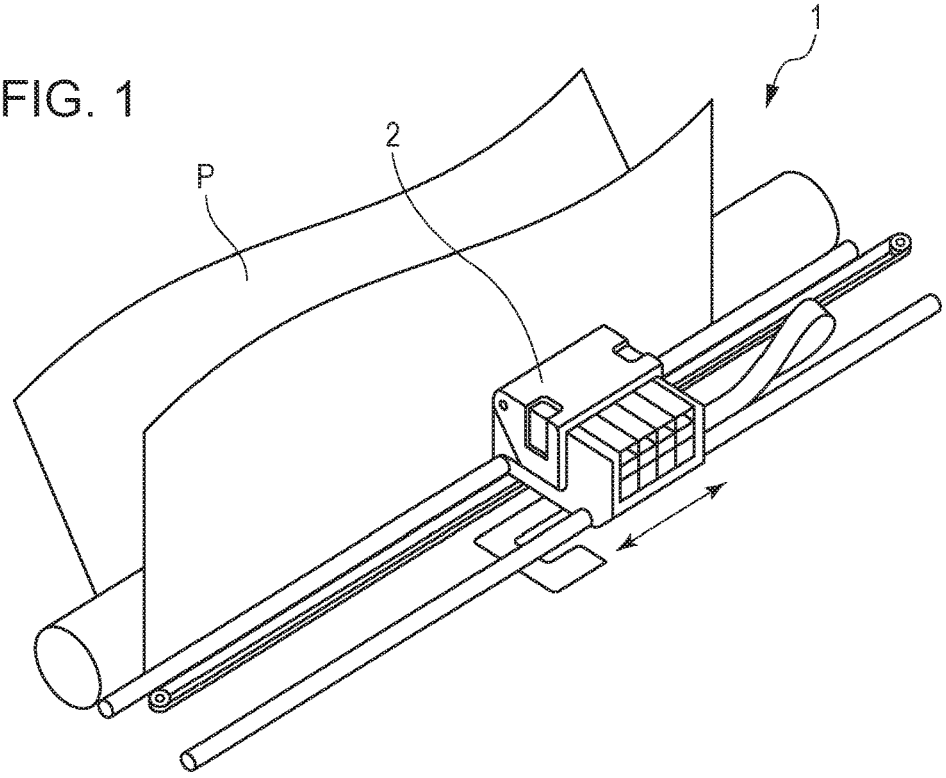
FIG. 1 is a perspective view schematically illustrating a main part of a liquid ejection apparatus in accordance with a first embodiment of the disclosure.

Hereinafter, embodiments of the disclosure will be described with reference to the drawings. In the drawings, components having the same functions are denoted by the same reference numerals and description thereof may be omitted.

First Embodiment

FIG. 1 is a perspective view schematically illustrating a main part of a liquid ejection apparatus in accordance with a first embodiment of the disclosure. A liquid ejection apparatus 1 illustrated in FIG. 1 is an inkjet recording apparatus which ejects ink as a liquid onto a recording medium P and records an image on the recording medium P. However, the disclosure is not limited to the inkjet recording apparatus but may be applicable to common liquid ejection apparatuses which eject liquids.

The liquid ejection apparatus 1 illustrated in FIG. 1 includes a liquid ejection head 2 which ejects a liquid. The liquid ejection head 2 is installed so that a surface from which a liquid is ejected faces the recording medium P. The liquid ejection apparatus 1 makes the liquid ejection head 2 eject the liquid while making the liquid ejection head 2 reciprocate in a direction depicted by an arrow in FIG. 1. With the ejection of the liquid, the liquid ejection apparatus 1 makes the recording medium P intermittently move in a direction which crosses the direction in which the liquid ejection head 2 reciprocates, whereby an image is recorded on the recording medium P.

Figure 2:
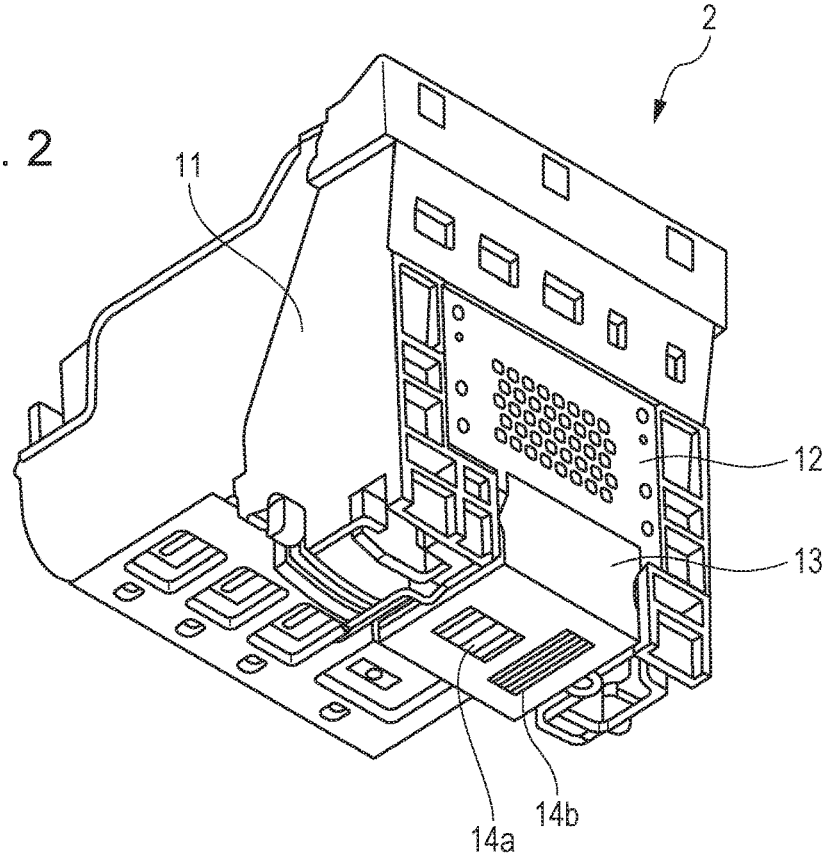
FIG. 2 is a perspective view schematically illustrating a liquid ejection head in accordance with the first embodiment of the disclosure.

FIG. 2 is a perspective view schematically illustrating an example of the liquid ejection head 2. The liquid ejection head 2 illustrated in FIG. 2 includes a housing 11, an electric connection board 12, an electric wiring board 13, and print element boards 14*a* and 14*b*. The electric connection board 12, the electric wiring board 13, and the print element boards 14*a* and 14*b* are attached to the housing 11.

Electrical signals are input to the electric connection board 12 from the outside (specifically, from a main body of the liquid ejection apparatus 1). The electrical signals include electric power for ejecting a liquid, logic signals for controlling ejection of the liquid, etc. The electric wiring board 13 has flexibility, and is attached to the housing 11 in a bent manner. The electric wiring board 13 electrically connects the electric connection board 12 to each of the print element boards 14*a* and 14*b*, and supplies the electrical signals input to the electric connection board 12 to each of the print element boards 14*a* and 14*b*. The print element boards 14*a* and 14*b* are connected to a tank (not illustrated) storing the liquid, and eject the liquid in the tank in accordance with the electrical signals from the electric connection board 12.

Figure 3:
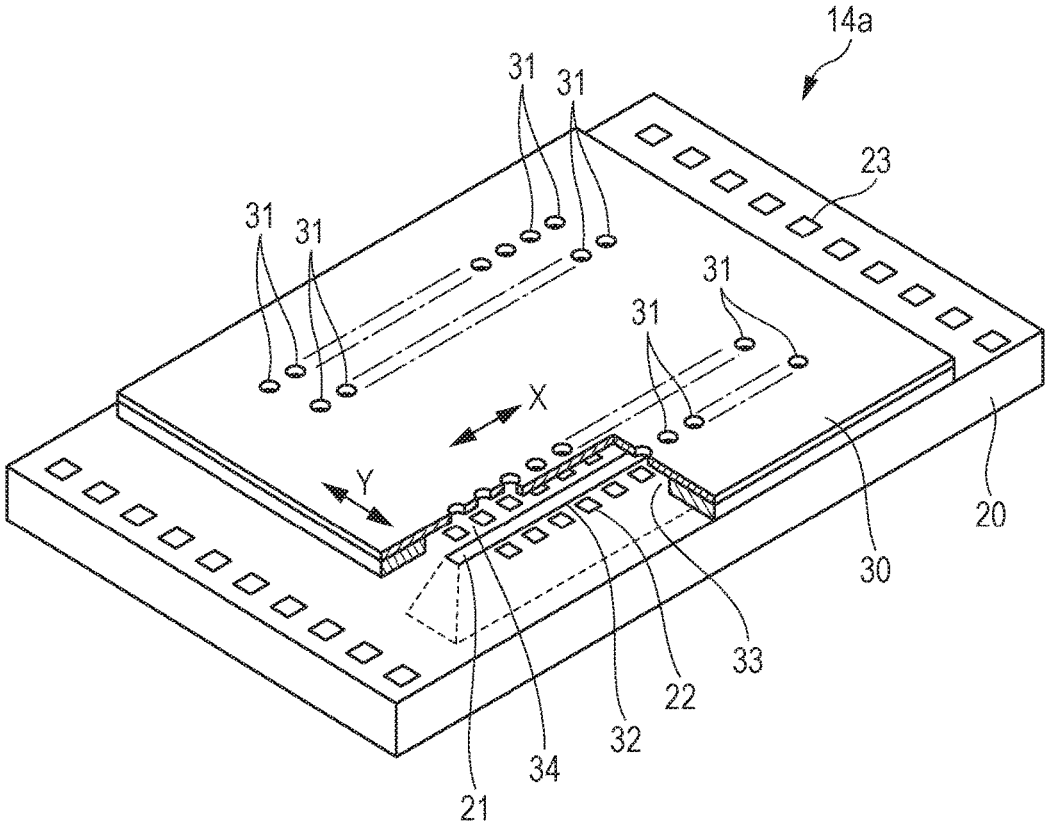
FIG. 3 is a perspective view schematically illustrating a print element board in accordance with the first embodiment of the disclosure.

FIG. 3 is a perspective view schematically illustrating the print element board 14*a*. In FIG. 3, the print element board 14*a* is illustrated in a partially broken state. The print element board 14*a* illustrated in FIG. 3 includes a substrate 20 and an ejection port forming member 30 provided on the substrate 20. In the present embodiment, a Si substrate is used as the substrate 20, and the ejection port forming member 30 is made of an epoxy-based resin material.

Inlets 21 to which the liquid is supplied from the tank are formed on the substrate 20. A plurality of inlets 21 is formed along a first direction X on the substrate 20 and is arranged in a second direction Y which crosses the first direction X. In the present embodiment, a plurality of inlets 21 is formed along a direction parallel to one side of the substrate 20 (specifically, a side along a longitudinal direction of the substrate 20), and is arranged along a direction orthogonally crossing that direction. At least four inlets 21 are provided.

Each of the inlets 21 penetrates through the substrate 20 from a first surface on which the ejection port forming member 30 is provided to a second surface opposite to the first surface on the substrate 20, and is formed so that an opening width thereof becomes gradually narrower as it approaches the first surface from the second surface.

A plurality of energy generating elements 22 is formed on the substrate 20 at predetermined pitches along each of the inlets 21. The energy generating elements 22 generate energy for the ejection of the liquid. Although the type of the energy generating elements 22 is not particularly limited, a heater for generating thermal energy is employed in the present embodiment.

The energy generating elements 22 and a driving circuit (not illustrated) for driving the energy generating elements 22 are integrated with the substrate 20. The driving circuit includes a switching element, a selection circuit, etc. On the substrate 20, a protective film (not illustrated) made of silicon nitride is formed on an interface between the substrate 20 and the ejection port forming member 30, and an anti-cavitation film (not illustrated) made of tantalum may be formed in a part of areas including the energy generating elements 22 and the periphery thereof.

Connection terminals 23 to which the electrical signals are supplied from the electric wiring board 13 illustrated in FIG. 2 are formed in the substrate 20. The connection terminals 23 are disposed on the substrate 20 where the ejection port forming member 30 is not provided. Specifically, the ejection port forming member 30 is disposed near a center of the substrate 20 in the longitudinal direction, and a plurality of connection terminals 23 is disposed along a width direction of the substrate 20 near both ends of the substrate 20 in the longitudinal direction.

In the ejection port forming member 30, ejection ports 31 from which the liquid is ejected are provided at positions corresponding to the energy generating elements 22 on the substrate 20. Specifically, the ejection port forming member 30 includes bubble generation chambers 32 for storing the liquid to be ejected from the ejection ports 31. Each of the bubble generation chambers 32 is disposed to face each of the energy generating elements 22. The ejection port 31 is formed to face the energy generating element 22 via the bubble generation chamber 32.

In the ejection port forming member 30, a plurality of flow paths 33 communicating with each of the bubble generation chambers 32, and common liquid chambers 34 distributing the liquid supplied from the inlets 21 on the substrate 20 to each of the flow paths 33 are formed. The flow path 33 is connected with the common liquid chamber 34 at one end and is connected with the bubble generation chamber 32 at the other end.

In the configuration described above, the liquid from the tank is supplied to the common liquid chambers 34 of the ejection port forming member 30 via the inlets 21 on the substrate 20. The liquid supplied to the common liquid chambers 34 is supplied to the bubble generation chambers 32 via the flow paths 33, and is stored in the bubble generation chambers 32. When the energy generating elements 22 generate energy in accordance with the electrical signals input to the connection terminals 23, the energy is transmitted to the liquid stored in the bubble generation chambers 32. With the energy, the liquid in the bubble generation chambers 32 is film-boiled and air bubbles are generated in the bubble generation chambers 32. Bubbling pressure caused by the air bubbles increases pressure in the bubble generation chambers 32, kinetic energy is applied to the liquid in the bubble generation chambers 32, and then the liquid is ejected from the ejection ports 31. The ejected liquid forms pixels (dots) of an image with respect to the recording medium P illustrated in FIG. 1. In this manner, an image is recorded on the recording medium P.

Hereinafter, the print element board 14*a* will be described in more detail.

Figure 4:
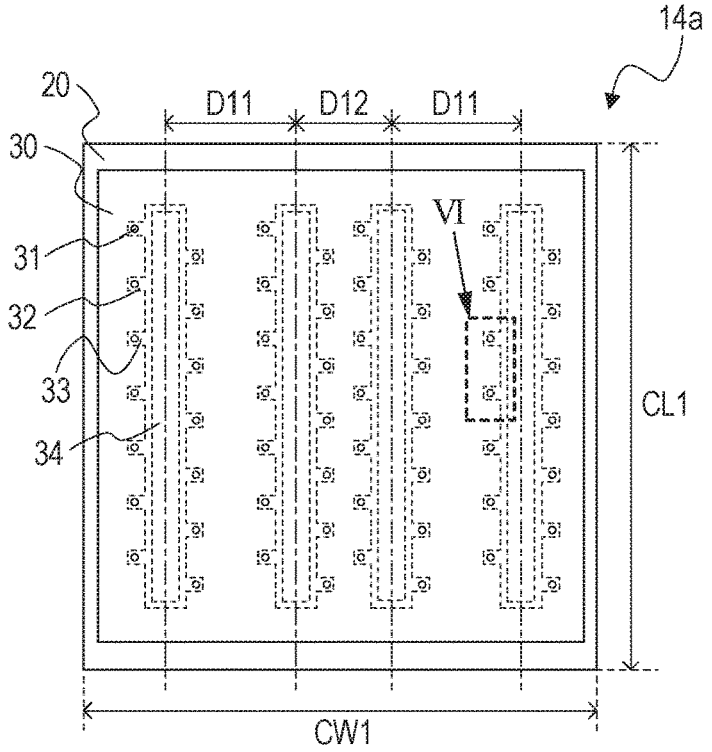
FIG. 4 is a top view schematically illustrating the print element board in accordance with the first embodiment of the disclosure.
Figure 5:
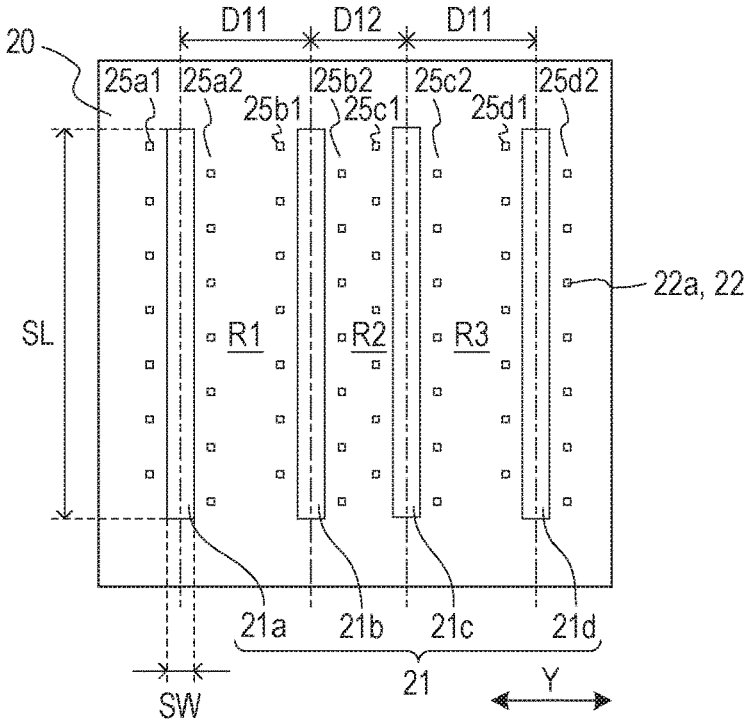
FIG. 5 is a top view schematically illustrating a substrate in accordance with the first embodiment of the disclosure.

FIG. 4 is a top view schematically illustrating the print element board 14*a* in accordance with the present embodiment, and FIG. 5 is a top view schematically illustrating the substrate 20 in accordance with the present embodiment.

As illustrated in FIGS. 4 and 5, in the print element board 14*a*, the ejection port forming member 30 is formed on the substrate 20 as also illustrated in FIG. 3. In the present embodiment, a thickness of the substrate 20 is 0.725 mm, and a thickness of the ejection port forming member 30 is 0.03 mm. A substrate width CW1 which is a width of the print element board 14*a* (the substrate 20) is 5.3 mm, and a substrate length CL1 which is a length of the print element board 14*a* (the substrate 20) is 15 mm.

In the ejection port forming member 30, the common liquid chambers 34 are formed along the longitudinal direction of the substrate 20. A plurality of ejection ports 31 and a plurality of bubble generation chambers 32 are formed along and on both sides of each of the common liquid chambers 34. Each of the flow paths 33 communicating the bubble generation chamber 32 and the common liquid chamber 34 is provided for each bubble generation chamber 32.

Inlets 21*a* to 21*d* are formed on the substrate 20 as the inlets 21. The inlets 21*a* to 21*d* are provided from one side of the substrate 20 in the order of the inlet 21*a*, the inlet 21*b*, the inlet 21*c*, and the inlet 21*d*. The inlets 21*a* to 21*d* are the same in shape, width SW (0.15 mm), and length SL (11.5 mm).

The substrate 20 is provided with heaters 22*a* as the energy generating elements 22, and heater arrays 25*a*1 to 25*d*2 consisting of a plurality of heaters 22*a* are formed along and on both sides of the inlets 21*a* to 21*d*. For the ease of illustration, seven heaters 22*a* are arranged in each of the heater arrays 25*a*1 to 25*d*2 in FIG. 5 but, actually, 256 heaters 22*a* are arranged at a density of 600 dpi (at a pitch of about 0.0423 mm). The ejection ports 31 and the bubble generation chambers 32 illustrated in FIG. 4 are formed to face the heaters 22*a*, and the common liquid chambers 34 are formed to face the inlets 21*a* to 21*d*.

Areas sandwiched between adjacent inlets 21 are defined as inter-inlet areas R1 to R3 in the order from the inlet 21*a* side. The inter-inlet areas R1 to R3 have at least two types of areas which are different in inter-inlet distance which is a distance between inlets 21 adjacent to each other. Among the inter-inlet areas R1 to R3, the inter-inlet areas R1 and R3 positioned on both ends of the substrate 20 in the second direction Y are different from the area with the shortest inter-inlet distance. That is, the area with the shortest inter-inlet distance among the inter-inlet areas R1 to R3 is positioned in an area other than both ends of the substrate 20 in the second direction Y among the inter-inlet areas R1 to R3. In the present embodiment, each of inter-inlet distances D11 between the inlet 21*a* and the inlet 21*b* and between the inlet 21*c* and the inlet 21*d* is 1.3 mm, and an inter-inlet distance D12 between the inlet 21*b* and the inlet 21*c* is 1.1 mm. Therefore, the area with the shortest inter-inlet distance is the inter-inlet area R2 sandwiched between the inlet 21*b* and the inlet 21*c*. Here, the inter-inlet distance is a distance between center lines extending in the longitudinal direction of adjacent inlets 21.

Figure 6:
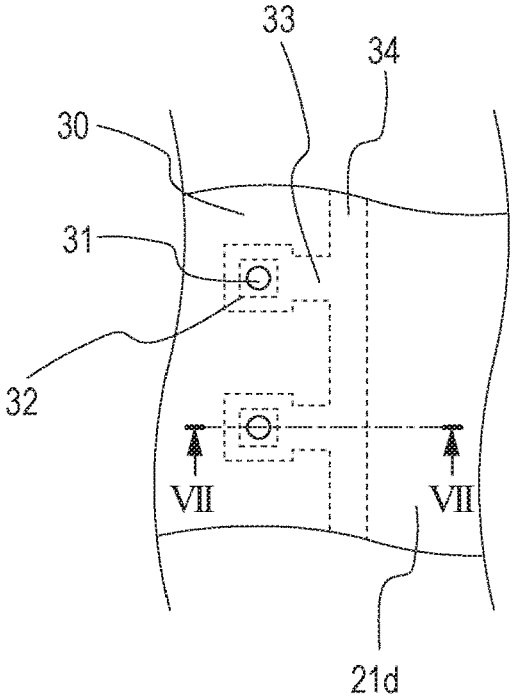
FIG. 6 is an enlarged view of an area VI of FIG. 4.
Figure 7:
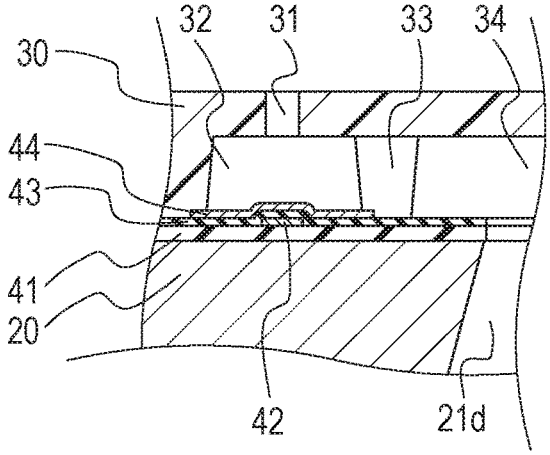
FIG. 7 is a cross-sectional view along line VII-VII of FIG. 6.

FIG. 6 is an enlarged view of an area VI of FIG. 4. FIG. 7 is a cross-sectional view along line VII-VII of FIG. 6.

As illustrated in FIG. 7, a heat accumulation layer 41 made of silicon oxide is formed on the substrate 20. A heater layer 42 made of TaSiN and a protective film layer 43 made of silicon nitride are formed on the heat accumulation layer 41. The heater layer 42 and a heater electrode layer (not illustrated) constitute the heater 22*a*. An anticavitation layer 44 made of tantalum is formed on the protective film layer 43 in an area corresponding to the heater 22*a*. In the present embodiment, the heat accumulation layer 41, the heater layer 42, the protective film layer 43, and the anticavitation layer 44 are formed integrally on the substrate 20 by a semiconductor manufacturing process. Further, the ejection port forming member 30 is formed on the protective film layer 43 and the anticavitation layer 44.

In the configuration described above, if a temperature change etc. occurs in the print element board 14*a*, stress may be caused in the print element board 14*a* and the print element board 14*a* may be deformed by the stress. The stress usually increases from the central portion toward an outer peripheral portion of the substrate 20. Since the shorter the inter-inlet distance, the higher a ratio of the inlet 21 to the substrate 20 becomes, the inter-inlet areas R1 to R3 have lower rigidity and are more easily affected by the stress in the area with the shorter inter-inlet distance.

In the present embodiment, the inter-inlet area R2 with the shortest inter-inlet distance is disposed at a position different from both ends of the substrate 20. Therefore, the inter-inlet area R2 with the lowest rigidity among the inter-inlet areas R1 to R3 is disposed separated from both ends of the substrate 20 which are most easily affected by the stress. Therefore, the influence of the stress can be reduced, and peeling of the ejection port forming member 30 away from the substrate 20 can be reduced.

As a liquid ejection head of a first comparative example, a liquid ejection head in which an inter-inlet distance in an inter-inlet area R1 is 1.1 mm, and an inter-inlet distance in inter-inlet areas R2 and R3 is 1.3 mm is prepared and compared with the liquid ejection head 2 of the present embodiment. The liquid ejection head of the first comparative example is the same with the liquid ejection head 2 of the present embodiment in configuration except for the inter-inlet distance.

A temperature cycle test (−20° C. and 80° C.) is conducted 100 times to the liquid ejection head of the first comparative example. In this case, peeling of the ejection port forming member 30 away from the substrate 20 occurred near a center of a heater array 25*a*2 corresponding to the inlet 21*a* in 8 out of 10 samples. When the same temperature cycle test is conducted 100 times to the liquid ejection head 2 of the present embodiment, peeling of the ejection port forming member 30 away from the substrate 20 occurred near the center of the heater array 25*a*2 corresponding to the inlet 21*a* only in 2 out of 10 samples. This result shows that the liquid ejection head 2 of the present embodiment is capable of further reducing peeling of the ejection port forming member 30 away from the substrate 20.

Second Embodiment

Figure 8:
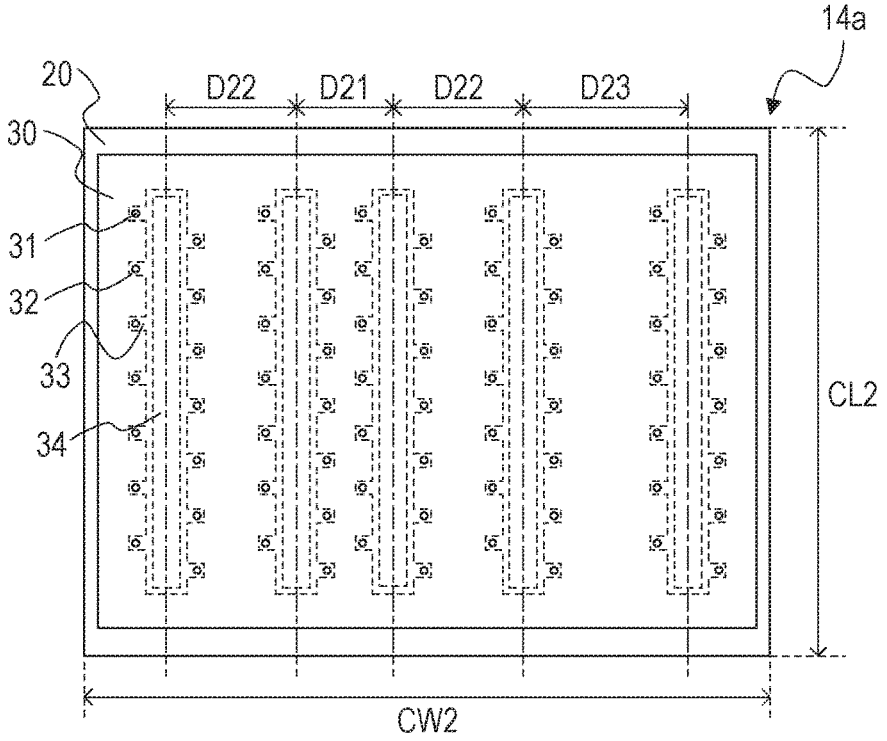
FIG. 8 is a top view schematically illustrating a print element board in accordance with a second embodiment of the disclosure.
Figure 9:
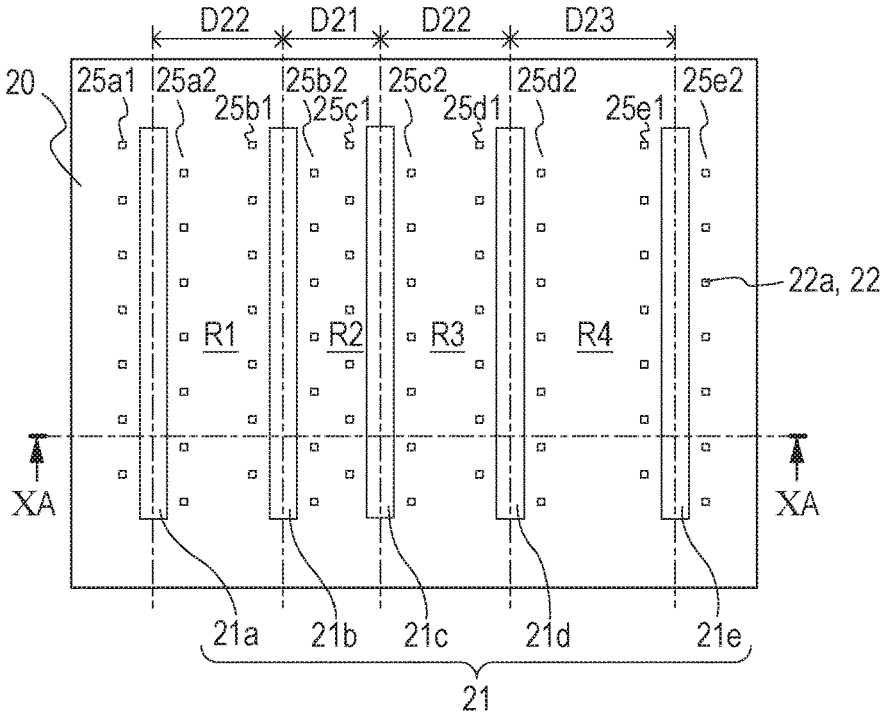
FIG. 9 is a top view schematically illustrating a substrate in accordance with the second embodiment of the disclosure.

FIG. 8 is a top view schematically illustrating a print element board 14*a* in accordance with a second embodiment of the disclosure, and FIG. 9 is a top view schematically illustrating a substrate 20 in accordance with the second embodiment of the disclosure. In an example illustrated in FIGS. 8 and 9, a substrate width CW2 which is a width of the print element board 14*a* (the substrate 20) is 6.9 mm, and a substrate length CL2 which is a length of the print element board 14*a* (the substrate 20) is 15 mm. A thickness of the substrate 20 and a thickness of an ejection port forming member 30 are the same as those of the first embodiment.

Inlets 21*a* to 21*e* are formed on the substrate 20 as the inlets 21. The inlets 21*a* to 21*e* are formed along one side of the substrate 20, and are provided from one side of the substrate 20 in the order of the inlet 21*a*, the inlet 21*b*, the inlet 21*c*, the inlet 21*d*, and the inlet 21*e*. Heater arrays 25*a*1 to 25*e*2 consisting of a plurality of heaters 22*a* are formed along the inlets 21*a* to 21*e*. The shape of the inlet 21 is the same as that of the first embodiment.

Areas sandwiched between adjacent inlets 21 are defined as inter-inlet areas R1 to R4 in the order from the inlet 21*a* side. In the present embodiment, the inter-inlet areas R1 to R4 have at least three types of areas which are different in inter-inlet distance. An inter-inlet area with the longest inter-inlet distance and an inter-inlet area with the shortest inter-inlet distance are not adjacent to each other.

Specifically, an inter-inlet distance D22 in each of the inter-inlet areas R1 and R3 is 1.3 mm, an inter-inlet distance D21 in the inter-inlet area R2 is 1.1 mm, and an inter-inlet distance D23 in the inter-inlet area R4 is 1.6 mm. Therefore, the inter-inlet area with the longest inter-inlet distance is the inter-inlet area R4, and the inter-inlet area with the shortest inter-inlet distance is the inter-inlet area R2, and the inter-inlet areas R2 and R4 are not adjacent to each other.

In the configuration described above, if a temperature change etc. occurs in the print element board 14*a*, stress may be caused in the print element board 14*a* and the print element board 14*a* may be deformed by the stress.

Figure 10A:
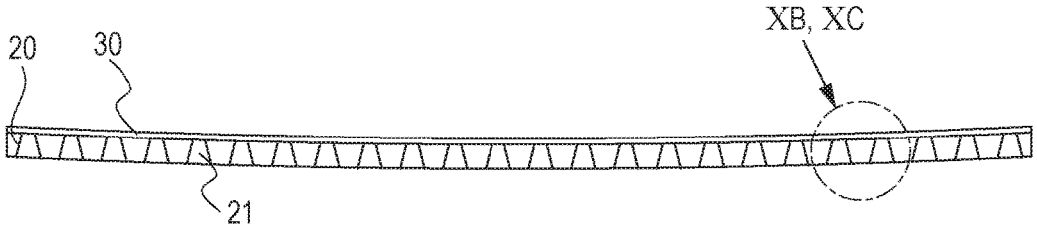
FIGS. 10A to 10C are diagrams illustrating deformation of the print element board in more detail.
Figure 10B:
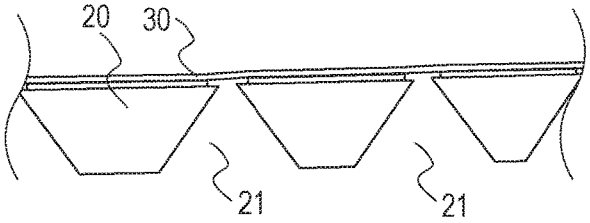
Figure 10C:
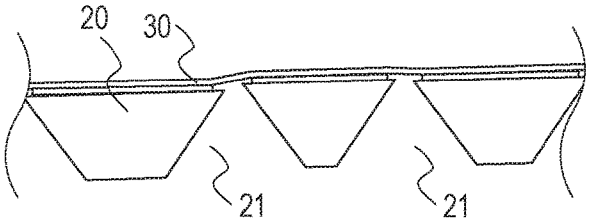

FIGS. 10A to 10C are diagrams illustrating deformation of the print element board 14*a* in more detail. FIG. 10A is a cross-sectional view along line XA-XA of FIG. 9. FIGS. 10B and 10C are enlarged views of areas XB and XC of FIG. 10A, respectively.

When stress is caused in the print element board 14*a*, the print element board 14*a* is deformed because of lowered rigidity of the substrate 20 caused by formation of the inlets 21, a difference in stress between the substrate 20 and the ejection port forming member 30, etc. Specifically, as described in the first embodiment, since the stress increases from the central portion toward an outer peripheral portion of the substrate 20, the entire print element board 14*a* deforms in a bowl shape as illustrated in FIG. 10A.

In the inter-inlet area, since the longer the inter-inlet distance, the lower a ratio of the inlet 21 to the substrate 20 becomes, a volume occupied by the substrate 20 in the inter-inlet area is increased. Therefore, the greater the difference in inter-inlet distance between the inter-inlet areas adjacent to each other, the greater the difference in volume occupied by the substrate 20 in these inter-inlet areas becomes. The smaller the difference in volume, the smaller the relative deformation amount between adjacent inter-inlet areas becomes as illustrated in FIG. 10B. The greater the difference in volume, the greater the relative deformation amount between adjacent inter-inlet areas becomes as illustrated in FIG. 10C. Therefore, the greater the difference in inter-inlet distance between the inter-inlet areas adjacent to each other, the more easily the ejection port forming member 30 is peeled away from the substrate 20.

In the present embodiment, since the inter-inlet area R4 with the longest inter-inlet distance and the inter-inlet area R2 with the shortest inter-inlet distance are not adjacent to each other, deformation caused by a difference in volume occupied by the substrate 20 in the inter-inlet areas adjacent to each other can be decreased. Therefore, peeling of the ejection port forming member 30 away from the substrate 20 can be reduced.

As a liquid ejection head of a second comparative example, a liquid ejection head in which an inter-inlet distance in each of inter-inlet areas R1 and R4 is 1.3 mm, an inter-inlet distance in an inter-inlet area R2 is 1.1 mm, and an inter-inlet distance in an inter-inlet area R3 is 1.6 mm is prepared and compared with the liquid ejection head 2 of the present embodiment. The liquid ejection head of the second comparative example is the same with the liquid ejection head 2 of the present embodiment in configuration except for the inter-inlet distance.

A temperature cycle test (−20° C. and 80° C.) is conducted 100 times to the liquid ejection head of the second comparative example. In this case, peeling of the ejection port forming member 30 away from the substrate 20 occurred near a center of the heater array 25*a*2 corresponding to the inlet 21*a* in 8 out of 10 samples. When the same temperature cycle is conducted 100 times to the liquid ejection head 2 of the present embodiment, peeling of the ejection port forming member 30 away from the substrate 20 occurred near the center of the heater array 25*a*2 corresponding to the inlet 21*a* only in 2 out of 10 samples. This result shows that the liquid ejection head 2 of the present embodiment is capable of further reducing peeling of the ejection port forming member 30 away from the substrate 20.

Although five inlets 21 are provided in the second embodiment described above, at least four inlets 21 are sufficient practically.

Third Embodiment

Figure 11:
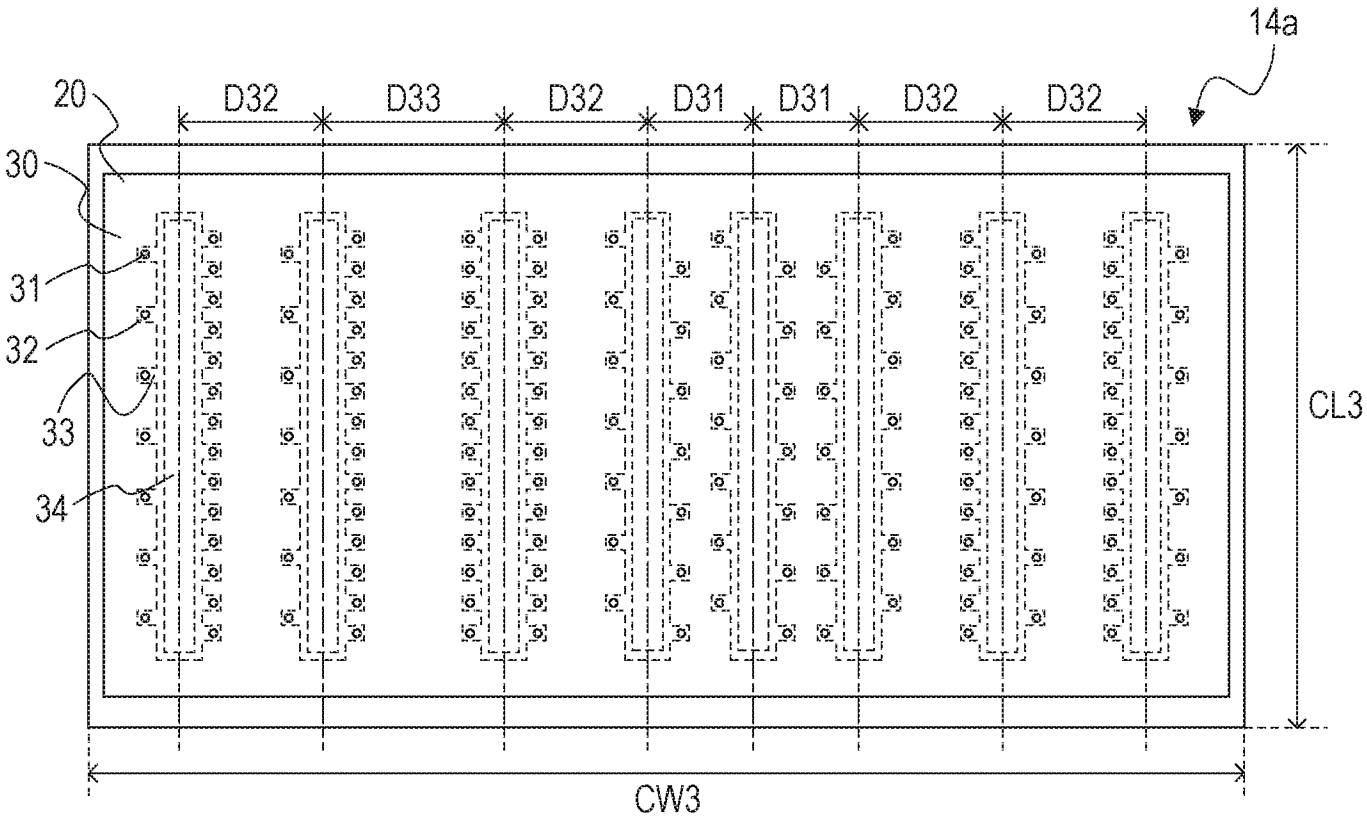
FIG. 11 is a top view schematically illustrating a print element board in accordance with a third embodiment of the disclosure.
Figure 12:
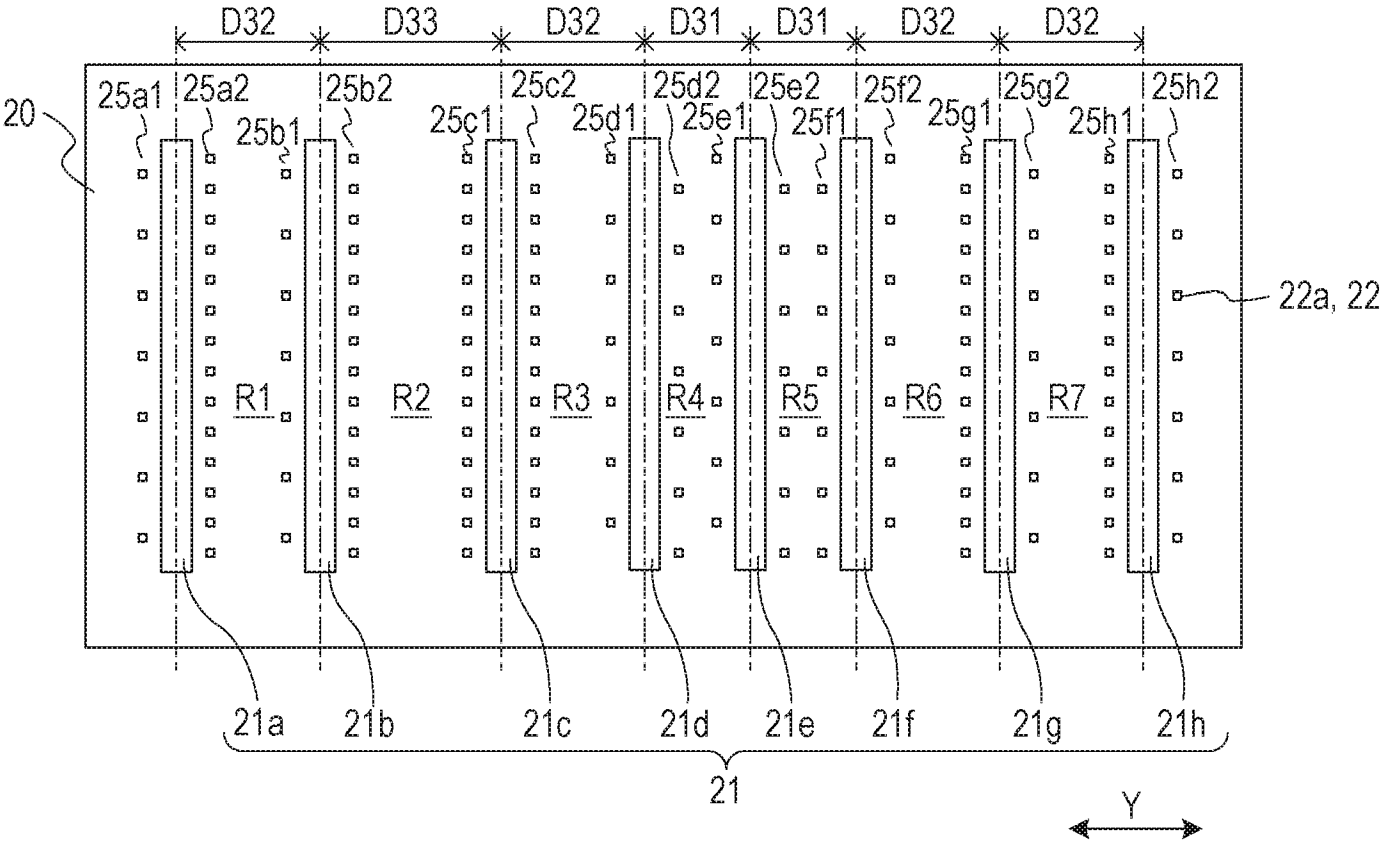
FIG. 12 is a top view schematically illustrating a substrate in accordance with the third embodiment of the disclosure.

FIG. 11 is a top view schematically illustrating a print element board 14*a* in accordance with a third embodiment of the disclosure, and FIG. 12 is a top view schematically illustrating a substrate 20 in accordance with the third embodiment of the disclosure. In an example illustrated in FIGS. 11 and 12, a substrate width CW3 which is a width of the print element board 14*a* (the substrate 20) is 10.4 mm, and a substrate length CL3 which is a length of the print element board 14*a* (the substrate 20) is 15 mm. A thickness of the substrate 20 and a thickness of an ejection port forming member 30 are the same as those of the first embodiment.

Inlets 21*a* to 21*h* are formed on the substrate 20 as the inlets 21. The inlets 21*a* to 21*h* are formed along one side of the substrate 20, and are provided from one side of the substrate 20 in the order of the inlet 21*a*, the inlet 21*b*, the inlet 21*c*, the inlet 21*d*, the inlet 21*e*, the inlet 21*f*, the inlet 21*g*, and the inlet 21*h*. Heater arrays 25*a*1 to 25*h*2 consisting of a plurality of heaters 22*a* are formed along the inlets 21*a* to 21*h*.

In the heater arrays 25*a*1, 25*b*1, 25*d*1, 25*d*2, 25*e*1, 25*e*2, 25*f*1, 25*f*2, 25*g*2, and 25*h*2, 256 heaters 22*a* are arranged at a density of 600 dpi (at a pitch of about 0.0423 mm). In the heater arrays 25*a*2, 25*b*2, 25*c*1, 25*c*2, 25*g*1, and 25*h*1, 512 heaters 22*a* are arranged at a density of 1200 dpi (at a pitch of about 0.0211 mm).

Areas sandwiched between adjacent inlets 21 are defined as inter-inlet areas R1 to R7 in the order from the inlet 21*a* side. The inter-inlet areas R1 to R7 have at least three types of areas which are different in inter-inlet distance. As in the first embodiment, among the inter-inlet areas R1 to R7, the inter-inlet areas R1 and R7 positioned on both ends of the substrate 20 in a second direction Y are each different from the area with the shortest inter-inlet distance. As in the second embodiment, an inter-inlet area with the longest inter-inlet distance and an inter-inlet area with the shortest inter-inlet distance are not adjacent to each other.

Specifically, an inter-inlet distance D31 in each of the inter-inlet areas R4 and R5 is 1.1 mm, an inter-inlet distance D33 in the inter-inlet area R2 is 1.6 mm, and an inter-inlet distance D32 of each of the other inter-inlet areas R1, R3, R6, and R7 is 1.3 mm. Therefore, the inter-inlet areas R4 and R5 are the areas with the shortest inter-inlet distance, and the inter-inlet area R2 is the area with the longest inter-inlet distance. Therefore, the inter-inlet areas R1 and R7 positioned on both ends of the substrate 20 are different from the areas with the shortest inter-inlet distance, and the inter-inlet area R2 with the longest inter-inlet distance is not adjacent to the inter-inlet areas R4 and R5 with the shortest inter-inlet distance. Therefore, in the present embodiment, peeling of the ejection port forming member 30 away from the substrate 20 can be reduced in the liquid ejection head 2.

As a liquid ejection head of a third comparative example, a liquid ejection head in which an inter-inlet distance in each of inter-inlet areas R1 and R7 is 1.1 mm, an inter-inlet distance in an inter-inlet area R2 is 1.6 mm, and an inter-inlet distance of each of the other inter-inlet areas R3 to R6 is 1.3 mm is prepared. The liquid ejection head of the third comparative example is the same with the liquid ejection head 2 of the present embodiment in configuration except for the inter-inlet distance.

A temperature cycle test (−20° C. and 80° C.) is conducted 100 times to the liquid ejection head of the third comparative example. In this case, peeling of the ejection port forming member 30 away from the substrate 20 occurred near a center of the heater array 25*a*2 corresponding to the inlet 21*a* in 9 out of 10 samples. When the same temperature cycle is conducted 100 times to the liquid ejection head 2 of the present embodiment, peeling of the ejection port forming member 30 away from the substrate 20 occurred near the center of the heater array 25*a*2 corresponding to the inlet 21*a* only in 2 out of 10 samples. The same result is shown also near a center of the heater array 25*b*1 corresponding to the inlet 21*b*. This result shows that the liquid ejection head 2 of the present embodiment is capable of further reducing peeling of the ejection port forming member 30 away from the substrate 20.

As a liquid ejection head of a fourth comparative example, a liquid ejection head in which 512 heaters 22*a* are arranged at a density of 1200 dpi in heater arrays corresponding to the heater arrays 25*a*2, 25*b*1, 25*e*2, 25*f*1, 25*g*2, and 25*h*1 is prepared. The liquid ejection head of the fourth comparative example is the same with the liquid ejection head 2 of the present embodiment in configuration except for the density of the heaters 22*a*.

A temperature cycle test (−20° C. and 80° C.) is conducted 100 times to the liquid ejection head of the fourth comparative example. In this case, peeling of the ejection port forming member 30 away from the substrate 20 occurred near a center of the heater array 25*f*1 corresponding to the inlet 21*f* in 2 out of 10 samples. When the same temperature cycle is conducted 100 times to the liquid ejection head 2 of the present embodiment, peeling of the ejection port forming member 30 away from the substrate 20 occurred near the center of the heater array 25*f*1 corresponding to the inlet 21*f* only in 1 out of 10 samples. This result shows that the liquid ejection head 2 of the present embodiment is capable of further reducing peeling of the ejection port forming member 30 away from the substrate 20.

In each of the embodiments described above, the described configuration is illustrative only and the disclosure is not limited thereto. For example, the configuration of the print element board 14*a* described in each embodiment also is applicable to the print element board 14*b*.

According to the disclosure, since an inter-inlet area with the shortest inter-inlet distance is positioned on neither of ends of the substrate, the inter-inlet area with the lowest rigidity is not positioned in an area in which stress becomes the strongest. Further, since an inter-inlet area with the longest inter-inlet distance and an inter-inlet area with the shortest inter-inlet distance are not adjacent to each other, deformation caused by a difference in volume occupied by the substrate in the inter-inlet areas adjacent to each other can be decreased. Therefore, peeling of the ejection port forming member away from the substrate can be reduced.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-138189 filed Jul. 13, 2016, which is hereby incorporated by reference herein in its entirety.

What is claimed is:

1. A liquid ejection head, comprising:

a substrate in which at least four inlets to which a liquid is supplied are arranged; and an ejection port forming member provided on the substrate and provided with ejection port rows, wherein each of the ejection port rows includes a plurality of ejection ports arranged in a first direction, and the liquid supplied to the inlet is ejected from the ejection ports, wherein each of the inlets has a length that corresponds to the ejection port row and is formed continuously in the first direction, and the inlets are arranged in a second direction which crosses the first direction, and wherein a plurality of inter-inlet areas between the inlets adjacent to each other has at least two types of areas different in distance between the inlets adjacent to each other, and, among the inter-inlet areas, an area positioned on each of both ends of the substrate in the second direction is not an area in which the distance is the shortest.

2. The liquid ejection head according to claim 1, wherein the plurality of inter-inlet areas has at least three types of areas different in the distance, and an inter-inlet area in which the distance is the longest and an inter-inlet area in which the distance is the shortest are not adjacent to each other.

3. The liquid ejection head according to claim 1, wherein the first direction is parallel to one side of the substrate.

4. The liquid ejection head according to claim 3, wherein the one side is a side along the longitudinal direction of the substrate.

5. The liquid ejection head according to claim 1, wherein the second direction is orthogonal to the first direction.

6. A liquid ejecting apparatus, comprising:

a liquid ejection head including a substrate in which at least four inlets to which a liquid is supplied are arranged; and an ejection port forming member provided on the substrate and provided with ejection port rows, wherein each of the ejection port rows includes a plurality of ejection ports arranged in a first direction, and the liquid supplied to the inlet is ejected from the ejection ports, wherein each of the inlets has a length that corresponds to the ejection port row and is formed continuously in the first direction, and the inlets are arranged in a second direction which crosses the first direction, and wherein a plurality of inter-inlet areas between the inlets adjacent to each other has at least two types of areas different in distance between the inlets adjacent to each other, and, among the inter-inlet areas, an area positioned on each of both ends of the substrate in the second direction is not an area in which the distance is the shortest; and a carriage configured to hold the liquid ejection head.

* * * * *